US007255455B2

(12) United States Patent
Johansen

(10) Patent No.: US 7,255,455 B2
(45) Date of Patent: Aug. 14, 2007

(54) CANDLE EXTINGUISHER AND A METHOD FOR PRODUCING A CANDLE EXTINGUISHER

(76) Inventor: Knud Erik Johansen, Dragsbaedvej 80, Thisted (DK) DK-7700

( * ) Notice: Subject to any disclaimer, the term of this patent is extended or adjusted under 35 U.S.C. 154(b) by 47 days.

(21) Appl. No.: 11/033,034

(22) Filed: Jan. 11, 2005

(65) Prior Publication Data

US 2005/0158677 A1 Jul. 21, 2005

Related U.S. Application Data

(63) Continuation-in-part of application No. PCT/DK2004/000754, filed on Nov. 1, 2004, and a continuation-in-part of application No. PCT/DK03/00479, filed on Jul. 8, 2003.

(30) Foreign Application Priority Data

Jul. 11, 2002 (DK) ..... 2002 01089
Oct. 31, 2003 (DK) ..... 2003 01621

(51) Int. Cl.
*F21L 19/00* (2006.01)

(52) U.S. Cl. ..... 362/161; 431/35

(58) Field of Classification Search ..... 362/161; 431/35

See application file for complete search history.

(56) References Cited

U.S. PATENT DOCUMENTS

D241,465 S * 9/1976 Peterson ..... D26/10
4,818,214 A 4/1989 Ronnback ..... 431/35

FOREIGN PATENT DOCUMENTS

| | | |
|---|---|---|
| DE | 146094 | 12/1903 |
| DE | 162175 | 7/1905 |
| DE | 177488 | 11/1906 |
| GB | 23610 A | 9/1914 |
| WO | WO 02/057688 | 7/2002 |

* cited by examiner

*Primary Examiner*—Ali Alavi
*Assistant Examiner*—Hargobind S. Sawhney
(74) *Attorney, Agent, or Firm*—Klein, O'Neill & Singh, LLP; Howard J. Klein

(57) ABSTRACT

A candle extinguisher includes a body of thin-plate, non-combustible material, the body having a ring-shaped part defining an inner space, with an inner diameter at least slightly exceeding the outer diameter of a candle on which the extinguisher is to be positioned. The body has a plurality of flexible finger elements extending upwardly from the ring-shaped part, each of the finger elements having a proximal part and a distal part. The proximal finger parts extend substantially in coplanar relationship with the ring-shaped part and are bendable outwardly relative to the inner space defined by the ring-shaped part. The distal finger parts are bent substantially perpendicularly relative to a respective proximal part and extend inwardly relative to the inner space defined by the ring-shaped part, each of the distal parts having a length exceeding one half of the width of the inner space defined by the ring-shaped part.

8 Claims, 7 Drawing Sheets

CANDLE EXTINGUISHER AND A METHOD FOR PRODUCING A CANDLE EXTINGUISHER

CROSS-REFERENCE TO RELATED APPLICATIONS

This application is a continuation-in-part of co-pending International application no. PCT/DK2004/000754, filed Nov. 1, 2004, and it is also a continuation-in-part of co-pending International application no. PCT/DK2003/000479, filed Jul. 8, 2003, published Jan. 23, 2004 as International Publication No. WO 2004/008031. The disclosures of both of these prior co-pending International applications are expressly incorporated herein by reference.

FEDERALLY SPONSORED RESEARCH OR DEVELOPMENT

Not Applicable

BACKGROUND OF THE INVENTION

The present invention relates to a candle extinguisher comprising a unitary body of a thin plate material and made from a non-combustible or non-inflammable material, i.e. material which is not caused to burn, melt or otherwise be deteriorated when contacted with the burning flame of a candle or when exposed to the heat generated by the burning flame of a candle.

For centuries, a candle extinguisher has been used, which candle extinguisher is made from a conical metal cup having a rod constituting a handle by means of which the cup is positioned in an inverted state on the top of a candle for extinguishing the candle by preventing oxygen from being admitted to the burning candle.

The technique of extinguishing a burning candle has also been refined throughout several decades as candle extinguishers have been developed as described in, among others, DE 177488, DE 162195, U.S. Pat. No. 4,818,214 and WO 02057688. Reference is made to the above publications and the above US patent is hereby incorporated in the present specification by reference.

Common to these prior art candle extinguishers is the technical functionality of the extinguishers as the extinguishers have been developed for providing an automated functionality similar to the above-described candle extinguisher as the candle extinguishers described in the above publications are based on the technique of extinguishing a burning candle by closing off a compartment in which the burning flame is enclosed for causing the flame to be extinguished by the prevention of admission of oxygen to the burning flame.

SUMMARY OF THE INVENTION

The inventor has, through certain tests of thin plate candle extinguishers, to some extent resembling the candle extinguishers described in the above-mentioned publications, realized that an improvement of the automated candle extinguishing technique may be developed provided a different approach of causing the candle to be extinguished is deduced.

It is an object of the present invention to provide a candle extinguisher being made preferably in a unitary structure from a lightweight and inexpensive flame resistant material, such as carbon steel or stainless steel plate, which candle extinguisher provides a reliable extinguishing of a burning candle, eliminating the risk of not extinguishing the burning candle as is the case with the prior art candle extinguishers, which do not function if oxygen is admitted to the closed-off chamber in which the burning flame is enclosed. A risk exists in the prior art technique as a mechanical deterioration of the candle extinguisher or an extremely long burning flame may prevent the candle extinguisher from operating properly, meaning that the candle continues to burn, although the candle extinguisher is positioned correctly on the burning candle.

The above object together with numerous other objects, advantages and features which will be evident from the below detailed description of the presently preferred embodiments of the candle extinguisher according to the present invention are, according to the teachings of the present invention, obtained by a candle extinguisher comprising a unitary body of a thin-plate material, the thin-plate material being non-combustible or non-inflammable when exposed to the burning flame of a candle, the body having a ring-shaped part defining an inner space of the candle extinguisher and having an inner diameter at least slightly exceeding the outer diameter of a candle on which the candle extinguisher is to be positioned, the body having a plurality of flexible finger elements extending upwardly from said ring-shaped part, each of the flexible finger elements comprising a proximal part and a distal part, the proximal parts extending substantially in coplanar relationship with the ring-shaped part and being bendable from the coplanar relation outwardly relative to the inner space defined by the ring-shaped part, each of the distal parts being bent substantially perpendicularly relative to a respective proximal part and extending inwardly relative to the inner space defined by the ring-shaped part, each of the distal parts having a length at least exceeding one half of the width of the inner space defined by the ring-shaped part.

According to the teachings of the present invention, the candle extinguisher is of a structure different from the structure of the prior art candle extinguishers and further has a functionality different from the functionality of the prior art candle extinguishers. The candle extinguishers according to the present invention functions as follows:

The candle extinguisher is, before the lightning of a candle, positioned at a certain level or height above the supporting candle holder or a supporting surface such as a supporting table. The position corresponds to the height at which the candle is intended to be extinguished.

By the positioning of the candle extinguisher on the candle, the finger elements are bent outwardly as the proximal parts extend outwardly and as the outermost ends of the distal parts contact the outer circumference of the candle. Basically the candle, when positioned on a candle, resembles a light rosette. However, at the time of extinguishing the candle, at which time the candle has burned away until the level corresponding to the position of the upper end of the candle extinguisher, the distal parts of the finger elements are pressed into contact with the outer surface of the wick of the candle at a position below the burning flame.

The process of contacting the outer ends of the distal parts of the finger elements with the outer surface of the wick is a process in which the flexibility of the finger elements causes the distal parts to move from the contact with the outer surface of the candle into contact with the outer surface of the wick as the material of the candle is burned away, and, eventually, the outer ends of the distal parts of the finger elements tightly contact the outer surface of the wick and close off any space around the wick, and, in doing so, prevent the wick from transporting melted and combustible stearin or similar materials, such as wax, from the candle to the burning wick constituting the flame of the candle. As will be understood, the turning off or extinguishing of the candle by the candle extinguisher according to the present invention is a technique involving tightly closing off the top part of the wick which burns in the flame from the reservoir below the candle extinguisher.

According to the teachings of the present invention, the distal parts must have a length allowing the outer ends of the distal parts to be tightly pressed against the outer surface of the wick for closing off the burning part of the wick from the remaining part of the candle, and this closing off is established provided that the distal parts have a length at least exceeding one half of the width of the inner space defined by the ring-shaped part. Normally, the ring-shaped part has a circular cylindrical part and the half width of the inner space defined by the ring-shaped part consequently corresponds to the radius of the circular cylindrical part.

The candle extinguisher according to the present invention is preferably made as a unitary structure from a single thin plate of material, as the ring-shaped part and the flexible finger elements comprising the proximal parts and the distal parts are preferably made from one and the same flexible thin plate material, such as carbon steel or stainless steel or a high temperature resistant plastic material or another metal material, such as titanium, aluminum, copper, silver, gold or platinum or alloys thereof such as noble or semi-noble alloys. The thin plate material is preferably of a thickness of 50-500 μm, preferably approximately 100-150 μm, for allowing the proximal parts of the finger elements to be easily bent outwardly when positioning the candle extinguisher on the candle for the intentional use of the candle extinguisher. In order to obtain an adequate flexibility of the proximal parts of the finger elements, each of the proximal parts preferably has a length at least exceeding the lengths of the distal parts, such as, preferably, a length corresponding to approximately two times the length of the distal parts, or even more.

The proximal parts of the finger elements of the candle extinguisher according to the present invention may have any appropriate size and configuration, and may, e.g., be configured as thin plate elements, or alternatively as rectangular plate elements in combination defining a circumference substantially corresponding to the circumference of the ring-shaped part. According to the presently preferred embodiment of the candle extinguisher according to the present invention, the proximal parts are substantially of a rectangular configuration and the width of each of the proximal parts is at the most one half the length of the proximal part for providing a fairly easily flexible proximal part.

The distal parts exhibit, as discussed above, the feature characteristic of the present invention of defining a length at least exceeding one half the width of the inner space defined by the ring-shaped part. When fulfilling this feature, the distal parts may have any appropriate shape, such as a rectangular, a semi-elliptical or other shape or a combination thereof. However, according to the presently preferred embodiment of the candle extinguisher according to the present invention, the distal parts preferably have a shape substantially of an isosceles triangle, the base line of which is congruent with the outermost end of the respective proximal part, thereby providing a straight continuation of the proximal part.

Dependent on the size of the candle, the number of finger elements of the above-mentioned plurality of finger elements may vary from a fairly low integer to a fairly high integer such as between 3 and 30. It is contemplated that the number of finger elements may further advantageously and preferably be of the order of 5-20, such as 8-16 and according to the most preferred embodiment, the number of finger elements is 10 or 12.

The present invention also relates to a method of producing the candle extinguisher comprising a unitary body of a thin-plate material, said thin-plate material being non-combustible or non-inflammable when exposed to the burning flame of a candle, the body having a ring-shaped part defining an inner space of the candle extinguisher. and having an inner diameter at least slightly exceeding the outer diameter of a candle on which the candle extinguisher is to be positioned, the body having a plurality of flexible finger elements extending upwardly from the ring-shaped part, each of the flexible finger elements comprising a proximal part and a distal part, the proximal parts extending substantially in coplanar relationship with the ring-shaped part and being bendable from said coplanar relation outwardly relative to the inner space defined by the ring-shaped part, each of the distal parts being bent substantially perpendicularly relative to a respective proximal part and extending inwardly relative to the inner space defined by the ring-shaped part, and each of the distal parts having a length at least exceeding one half of the width of the inner space defined by the ring-shaped part, the method comprising the steps of (a) cutting a blank from a thin-plate material, the blank including a bottom shape part constituting a web of the thin-plate material and a plurality of flexible finger elements extending to the one side from the web and including inner parts and outer parts; (b) turning the blank into a cylindrical body having the web constituting the ring-shaped part and having the inner parts constituting the proximal parts and the outer parts constituting the distal parts; and (c) bending, in a single-step operation or a multi-step operation, the distal parts perpendicularly relative to the proximal parts.

The method according to the present invention allows the production of the candle extinguisher according to the present invention in an integrated process involving the machining of a thin metal plate exclusively in a continuous process or an intermittent process. According to alternative embodiments of the method according to the present invention, the steps of cutting the blank from the thin plate material is performed as a roller cutting operation, or, alternatively, as an intermittent operation involving the movement of a plunger in a reciprocating operation relative to the thin plate material, and, correspondingly, the step of bending the distal parts of the finger elements relative to the proximal parts of the finger elements may be performed in a single operation in which the distal parts are bent substantially perpendicular relative to the proximal parts, or, alternatively, in a two or three step operation involving, e.g., a pre-bending of the distal parts before turning the blank into the cylindrical body in an angle of approximately 45°, and a final bending step of further bending the distal parts a further 45° relative to the proximal parts for accomplishing the substantial perpendicular orientation of the distal parts relative to the proximal parts.

It is a well-known fact that candles (paraffin wax candles or the like burning with an open flame) are the cause of many fires. Especially at Christmas-time, when candles are used extensively together with easily combustible Christmas decorations, there is a considerable fire hazard. This fire hazard could, to some extent, be reduced if the candles were self-extinguishing, i.e. if the individual candle would extinguish automatically when it has burnt down to a certain position. The position should of course be chosen so that the flame in no circumstances will be able to get close to surrounding combustible material, such as spruce branches or the like while the candle burns down. This means that, in some cases, the chosen extinguishing position should be relatively high on the candle, and in other cases the extinguishing position can be further down on the candle close to the aperture in the candlestick without representing any fire hazard.

A self-extinguishing candle has already been designed where the wick is provided with an embedded blocking device preventing the flame from continuing down along the wick once the candle has burnt down to the device. As the user is not able to determine whether the extinguishing position is at a sufficiently high point on the candle in relation to surrounding combustible material, the use of the said type of candle still involves a certain element of risk. The user is unable to change the extinguishing position (blocking device) of a given candle, and it is not possible by looking at the candle to easily determine 1) whether it is provided with a blocking device, and 2) where any blocking device is located in the candle. In practice, therefore, the already known type of extinguisher involves considerable uncertainty.

The invention is based on the task of designing an extinguisher which does not embody the shortcomings and drawbacks connected with the above-mentioned known type of extinguisher with an embedded wick-blocking device. The precise purpose is to design a simple, easy-to-use and reliable extinguisher which the user can position on the candle at a selectable height, and which, by means of its extinguishing function, extinguishes the candle once it has burnt down to the position of the extinguisher.

According to the invention the problem is solved by designing an extinguisher comprising a resilient, slotted metal bushing, which at one end is provided with a number of elastic tongues. The tongues are, in the initial shape of the bushing, stamped so that the spring action will cause them to bend radially inward toward the center of the bushing, causing the tongues to close almost tightly at that end of the bushing. The bushing is, in shape and size, designed to be placed on the outside of a candle (paraffin wax candle or similar type of combustible candle) at the height on the candle where it should be extinguished. During mounting on the candle, the tongues will bend elastically outward, so that the bushing will enclose the candle. When the candle has burnt down to the level of the tongues, they will bend inward toward the center as a result of their elastic stamping (the initial shape of the tongues). In the closed position, the tongues will close tightly above and around the flame, thus smothering the fire.

In a preferred extinguisher design according to the invention, the bushing has, in its initial shape, been bent or rolled into a diameter less than the diameter of the smallest candle on which the extinguisher is to be placed. This makes the extinguisher self-retaining on the candle over a relatively large diameter range as a result of the extinguisher's resilient clamping action around the candle. The extinguisher can be placed at any desired height on the candle.

The extinguisher is suitably made of thin sheet steel, chiefly deformation-hardened (hard-rolled) carbon steel of a thickness ranging from 0.1-0.3 mm, depending on the diameter of the bushing. The material may be punched into the desired shape and subsequently shaped by stamping, rolling, press forming or another suitable forming operation. The material is inexpensive, and the extinguisher can therefore be made at a relatively low cost, for example for single use.

If made as specified in one embodiment of the invention, the tongues will have a well-defined closed position in an unloaded condition. In the closed position, it is important that the tongues close reasonably tightly so that the flame is smothered effectively.

In one embodiment, the bushing is provided with a radial inward-facing ring-shaped bulge placed in the area between the downward-facing edge of the bushing and the upward-facing edge which is slotted into the tongues. The bulge contributes to giving the extinguisher a firm grip on the candle, ensuring that the extinguisher is held at the desired height on the candle, even if the candle is tapered.

The spring effect of the tongues can, according to the invention, be increased by making the bushing of the well-known type of bimetal which changes shape when heated. The bimetal should be positioned so that the tongues will curve inward towards the center of the bushing when the metal is heated by the flame. This will increase the closing force of the tongues and consequently also the reliability of the extinguisher.

BRIEF DESCRIPTION OF THE DRAWINGS

The invention is now to be further described with reference to the drawings in which.

DETAILED DESCRIPTION OF THE INVENTION

Figure 1:
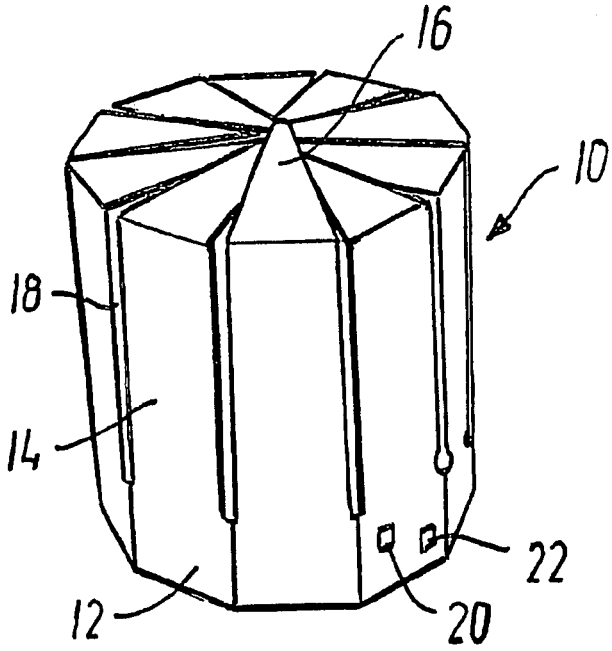
FIG. 1 is an overall schematic, perspective, and elevational view of a first and presently preferred embodiment of the candle extinguisher according to the present invention.

In FIG. 1, a first version or embodiment of a candle extinguisher according to the present invention is shown, designated by the reference numeral 10 in its entirety. The candle extinguisher 10 is made from flexible thin plate material, such as carbon steel of a thickness of 150 μm. The candle extinguisher 10 is, as will be described in greater detail below, produced in a punching or cutting, folding and bending operation, as the candle extinguisher 10 is produced as a unitary structure from the thin plate material. As is evident from FIG. 1, the candle extinguisher 10 comprises at its bottom end a circumferential ring-shaped part 12 from which a total of ten flexible finger elements 14 extend upwardly. The finger elements 14 basically comprise two parts, namely, a proximal part integrally connected to the ring-shaped part 12 of the candle extinguisher, and a distal part 16, which is bent substantially perpendicularly relative to the proximal part 14. The proximal part 14 extends in coplanar relation from the ring-shaped part 12 and is separated from its adjacent or neighboring finger element by a slot 18. The proximal parts 14 are of an overall rectangular configuration, whereas the distal parts 16 are of a triangular configuration having the base line of the triangle configured congruently with the upper most end of the proximal part 14.

It is to be realized that the terms such as "upper," "lower," "bottom," "top," "proximal," and "distal," as used in the present context, are all to be construed in the context of the intentional use of the candle extinguisher, as the candle extinguisher 10 is intended to be used mounted on a candle that is conventionally positioned vertically and having the ring-shaped part 12 as a lower most part of the candle extinguisher.

Figure 10:
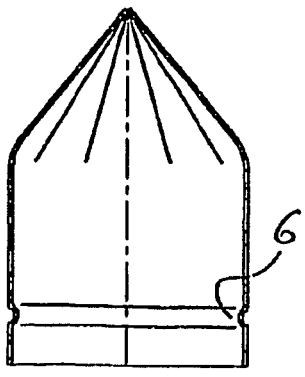
FIG. 10 is a vertical sectional view of the same along the center axis of the bushing.

In FIG. 1, the technique of assembling the blank from which the candle extinguisher 10 is produced is illustrated, as the reference numerals 20 and 22 respectively designate two thin metal plate flaps that are bent through perforations of the overlapping ring-shaped part 12 for maintaining the ring-shaped part 12 in the overall cylindrical or ring configuration, as illustrated in FIG. 10.

The candle extinguisher 10 may be produced in different sizes, such as a dimension corresponding to the diameter of the ring-shaped bottom part 12 ranging from about 14 mm-32 mm, such as produced in distinct sizes 14 mm, 22 mm, 24 mm, and 32 mm. Dependent on the diametrical size of the candle extinguisher, the height of the candle extinguisher may vary from approximately 20 mm-40 mm, as the height of the candle extinguisher is somewhat larger than the diameter of the candle extinguisher.

Figure 4A:
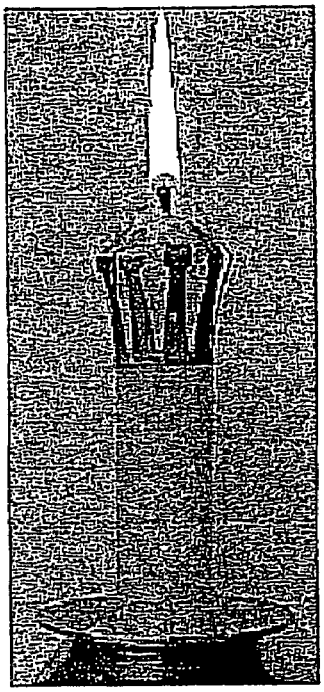
FIGS. 4*a*, 4*b*, and 4*c* are photographs illustrating the intentional use of the candle extinguisher illustrating the extinguishing of the candle by the separation of the flame from the remaining part of the candle without cutting of the burning wick part.
Figure 4B:
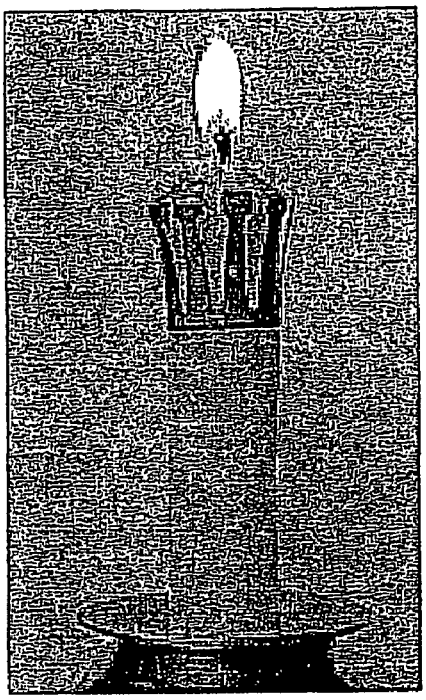
Figure 4C:
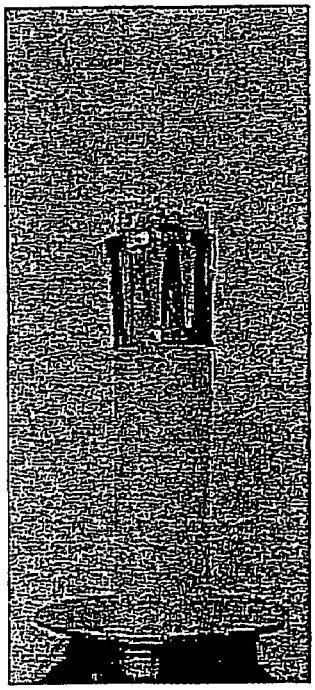
Figure 5:
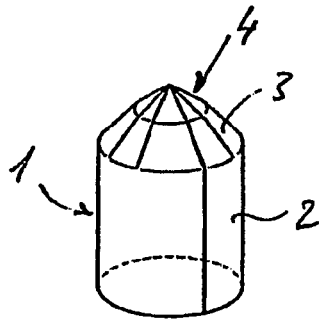
FIG. 5 shows a side view of an extinguisher in its initial position.
Figure 6:
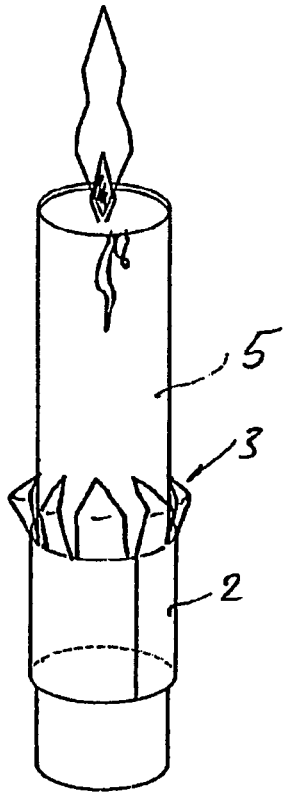
FIG. 6 shows the same mounted on a candle.
Figure 7:
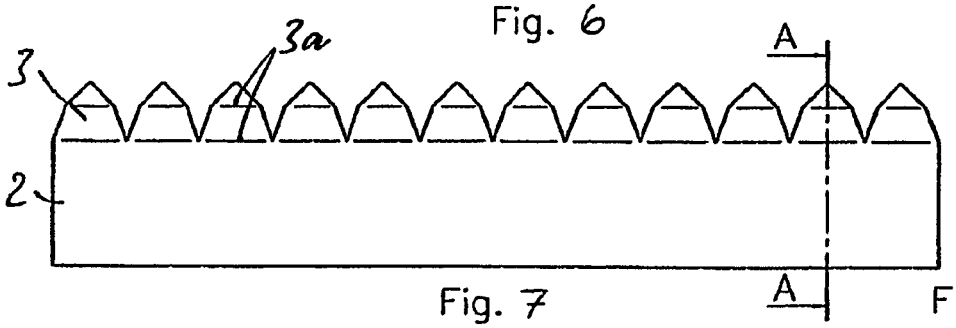
FIG. 7 shows the unfolded extinguisher, i.e. before being rolled into a bushing but after stamping of the tongues.

The slits 18 separating each of the finger elements 14 from its adjacent or neighboring finger element may extend to only a few millimeters above the lower rim of the ring-shaped part 12, as the ring-shaped part 12 merely serves the purpose of providing mechanical integrity and sufficient strength for allowing the finger elements 14 from being bent outwardly, as is illustrated in FIGS. 4*a*-4*c*.

The finger elements 14 are, in the embodiment shown in FIG. 10, of an overall width varying from about 3 mm-10 mm, depending on the diametrical dimension of the candle extinguisher, and the distal end parts 16 of the finger elements provide an overlap, as is illustrated in FIG. 1, since each of the distal end parts 16 has a length exceeding the radius of the ring-shaped part 12. Preferably, the distal end parts 16 have a length exceeding the one half the diameter of the ring-shaped part 12 by about 1-3 mm, such as 1.5-2 mm.

Figure 2:
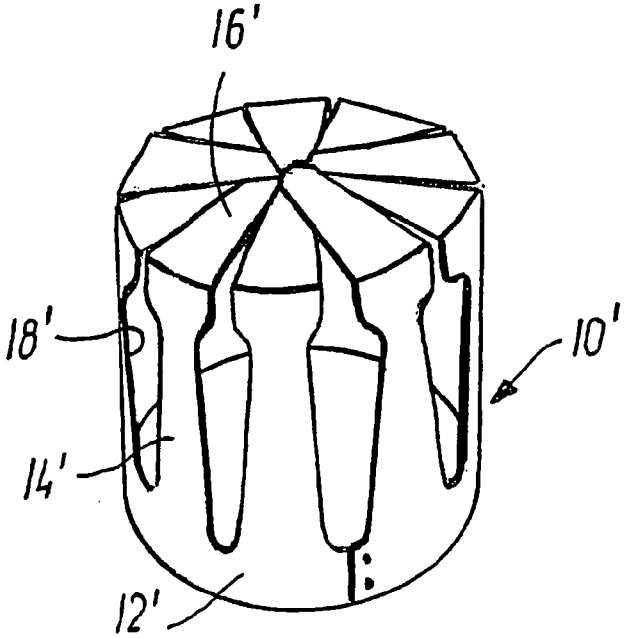
FIG. 2 is a view similar to the view of FIG. 1 of an alternative embodiment of the candle extinguisher according to the present invention.

In FIG. 2, a second or alternative embodiment of the candle extinguisher according to the present invention is shown, designated by the reference numeral 10' in its entirety. In FIG. 2, all elements or components serving the same purpose as elements or components, respectively, described above with reference to FIG. 1, however, differing geometrically from the above-described elements or components, are designated the same reference numeral as used in FIG. 1, but with the added marking'. As is evident from FIG. 2, the second embodiment 10' differs from the first embodiment 10 basically in that the finger elements 14' have their proximal ends tapering from the lower end to the upper end for providing, in their intended use, as is illustrated in FIG. 4*a*, a somewhat crown-like appearance.

Figure 3A:
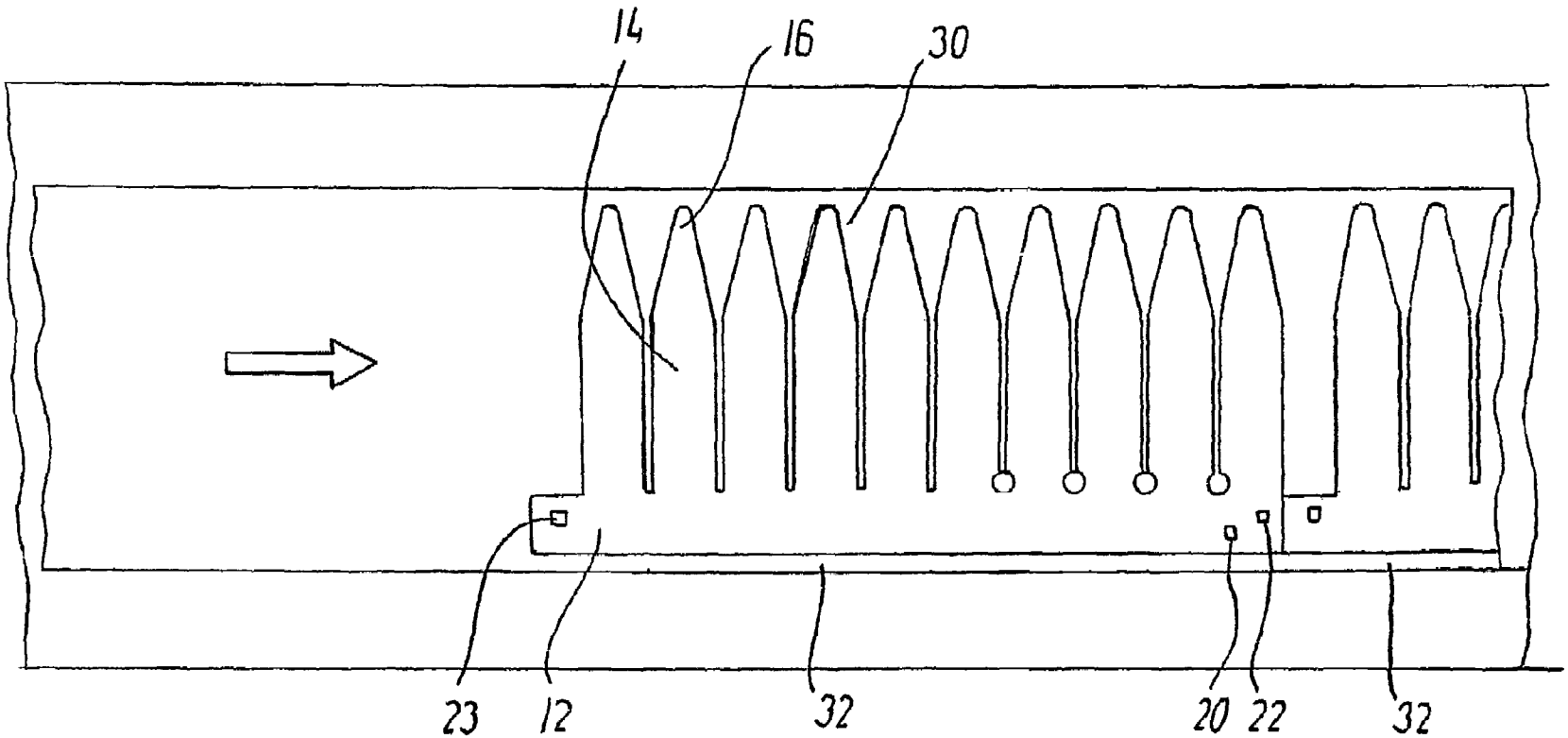
FIGS. 3*a*, 3*b*, 3*c*, and 3*d* are schematic views illustrating a presently preferred embodiment of cutting, partly bending, rolling and bending a blank into the candle extinguisher shown in FIG. 1.

In FIGS. 3*a*, 3*b*, 3*c*, and 3*d*, four steps of a process of producing the first and presently preferred embodiment of the candle extinguisher shown in FIG. 1 is illustrated, in which process, as illustrated in FIG. 3*a*, a blank 30 is cut or punched from a web of the thin plate material, which web is supplied from a roll not shown in the drawings. The blank 30 is punched by means of a vertically reciprocating plunger (not shown in the drawings), which is moved at a high speed, such as the speed of 1000 cycles/min., for producing 1000 candle extinguishers per minute.

A particular feature of the technique of producing the candle extinguisher, as is illustrated in FIGS. 3*a*-3*d*, relates to the utilization of an edge band 32 from the thin plate material web and serving as a support for the individual blanks until the candle extinguisher has been finalized from the blank, and also serving as a guide and propeller during the process of manufacturing the candle extinguisher.

Figure 3B:
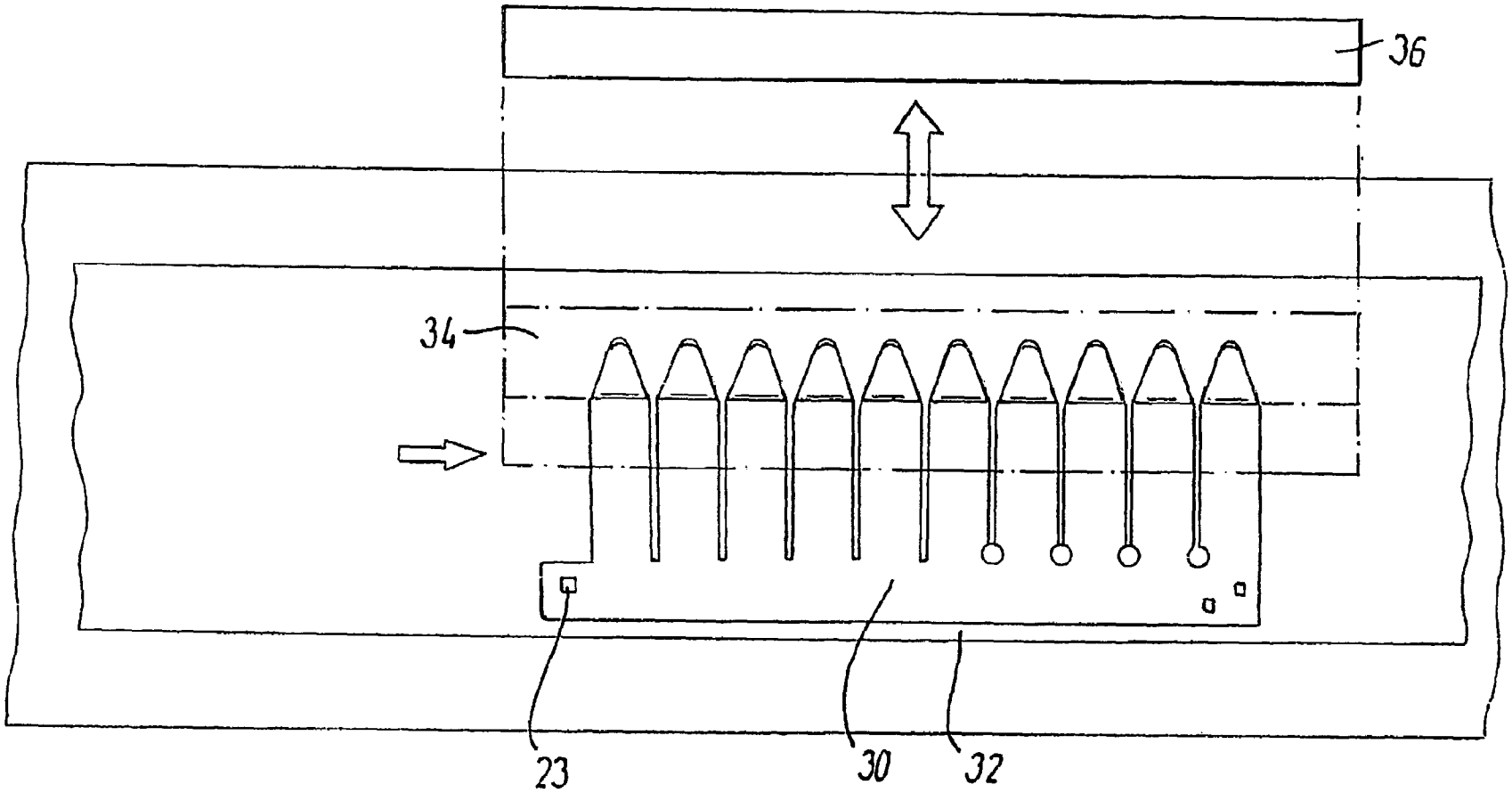

In FIG. 3*b*, the blank 30 is exposed to a bending process in which the distal parts 16 of the finger elements 14 are partly bent into an angle of approximately 45° relative to the proximal parts of the finger elements. The bending of the distal parts of the finger elements is accomplished by means of co-operating bending tools 34 and 36.

Figure 3C:
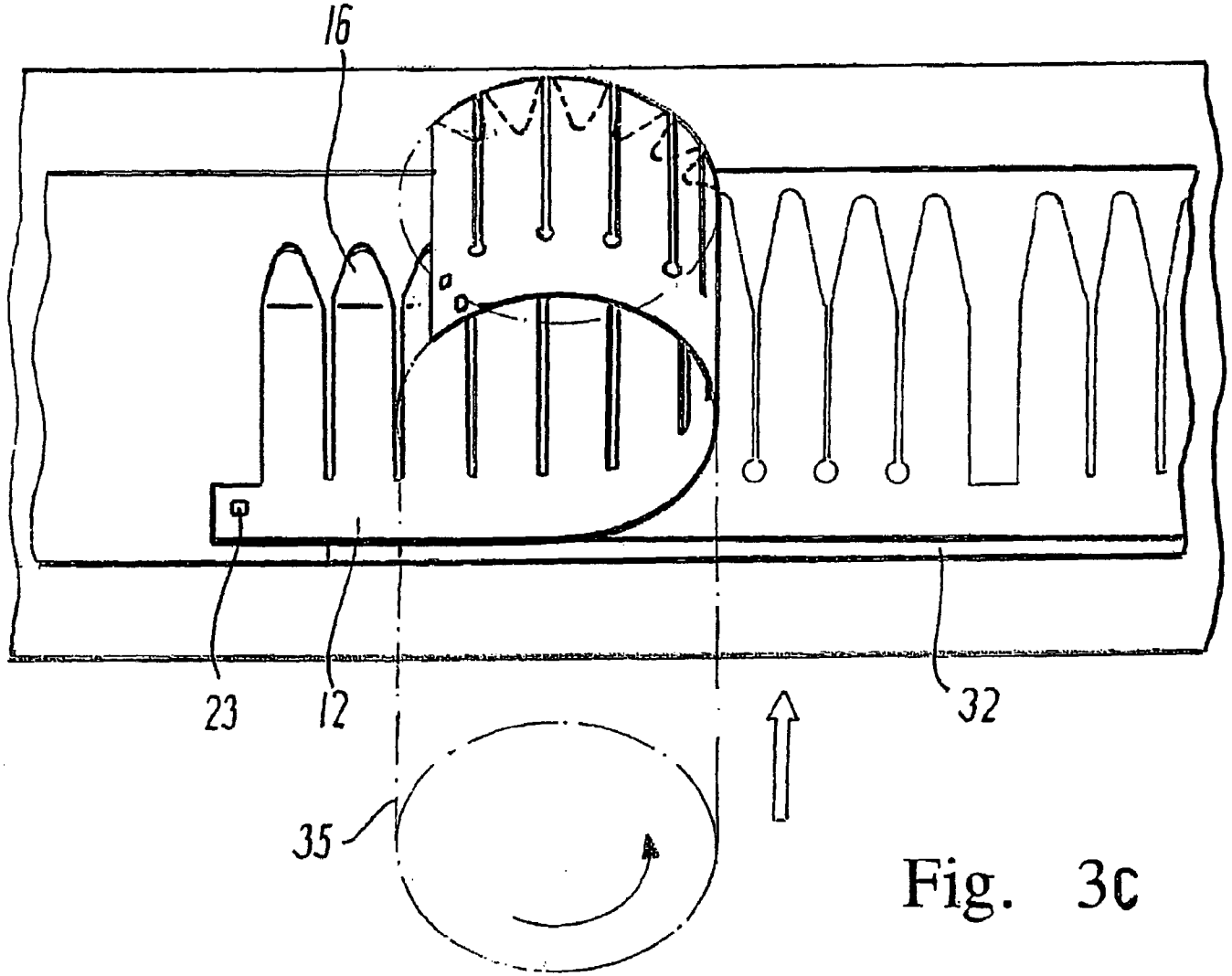

In FIG. 3*c*, the blank 30 is rolled into the circular cylindrical shape of the candle extinguisher, as due to the partial bending of the distal ends 16 of the finger elements 14, the rolling may be accomplished without causing the distal end parts 16 to jam the rolling process which inevitably would have been the situation if the distal end parts had been bent into the final perpendicular arrangement. The rolling is carried out by means of a mandrill 35 which is rotated as indicated by an arrow and a guiding tool 44.

Figure 3D:
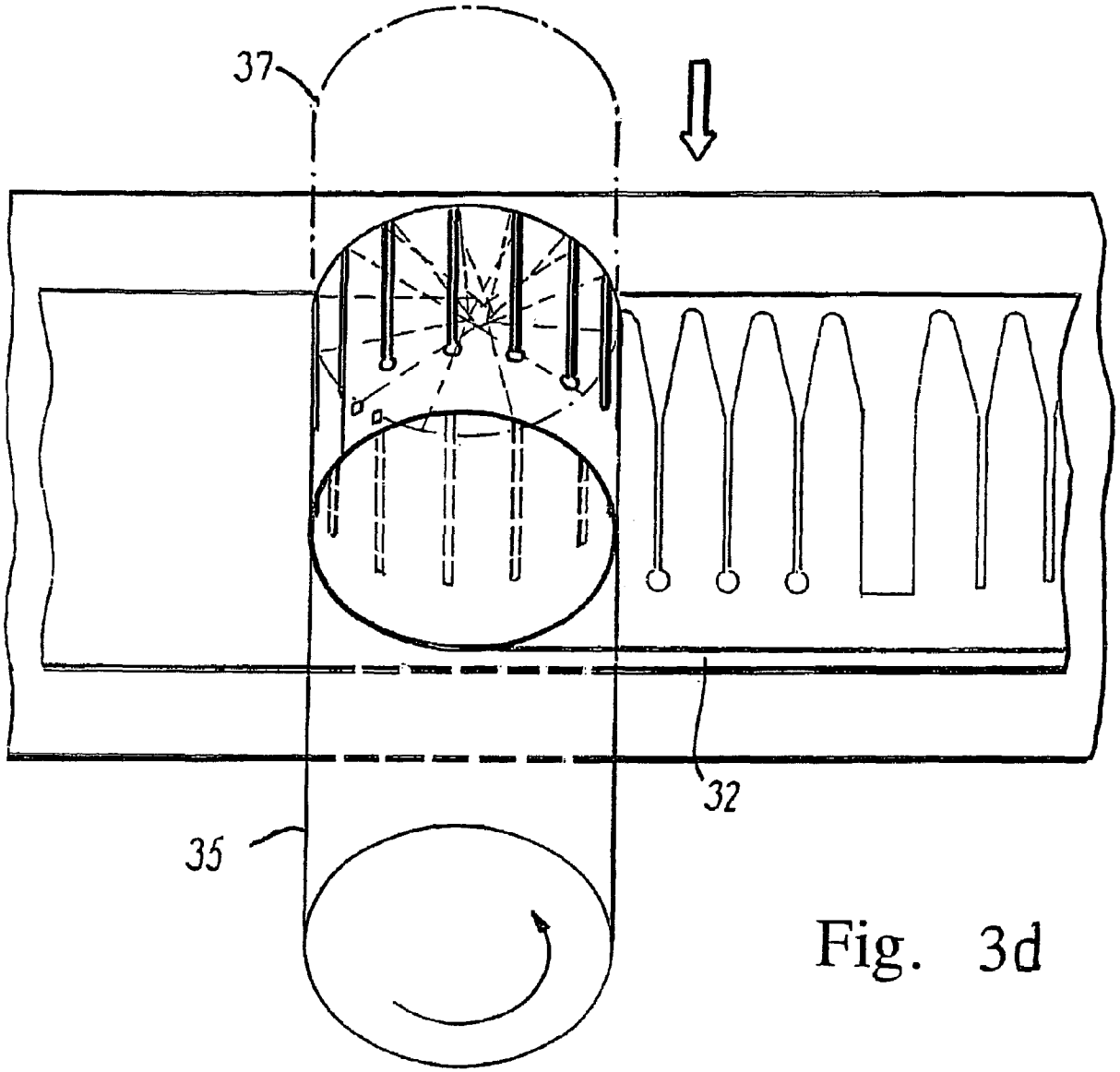

Finally, in the step illustrated in FIG. 3*d*, the blank rolled into the circular cylindrical shape is machined for causing the distal parts 16 of the finger elements 14 to be bent into the perpendicular position in the final product, as is illustrated in FIG. 1. The bending is accomplished while the blank is fixed to the mandrill 35 and generated by means of a pressing tool 37. Finally, after the bending of the distal parts 16 into the perpendicular arrangement relative to the proximal parts of the finger elements 14, the product is cut from the supporting edge band 32.

The technique illustrated in FIGS. 3*a*-3*d* may, for obvious reasons, be modified in numerous ways without deviating from the protective scope as defined in the appending claims. As an example, the mechanical fixation of the blank in the circular cylindrical configuration by means of the flaps 20 and 22 may be substituted by a spot-welding technique or a high frequency welding technique, and the geometrical shape of the blank, as is already mentioned above, may be modified without altering the functionality of the product of the candle extinguisher.

EXAMPLE

A prototype embodiment of the candle extinguisher 10 shown in FIG. 1 and produced as illustrated in FIGS. 3*a*-3*d*, was made from 150 μm carbon steel plate and cut into the blank shown in FIG. 3*a* by means of a punching tool. The length of the blank was in total 78 mm, the width of the ring-shaped part 12 was 6 mm, the width of each of the finger elements 14 was 6 mm, and the length of the proximal parts of the finger elements were 18 mm. The triangularly shaped distal parts 16 had an overall maximum length of 14 mm. The product manufactured from the above 150 μm carbon steel plate having the above measures was tested on several hundred candles and performed a swift and safe extinguishing of the candle.

Surprisingly, the extinguishing process turned out to be performed within only a few seconds from the time at which the distal parts 16 of the finger elements 14 were reaching above the edge of the candle until the outermost end of the distal parts 16 had separated the upper burning wick, i.e., the flame from the remaining part of the candle without cutting off the wick, still preventing any combustible wax or stearinous material from being sucked into the burning flame. The photographs of FIGS. 4*a*-4*c* illustrating the extinguishing process correspondingly represent a period of time of merely 5-10 sec.

Figure 8:
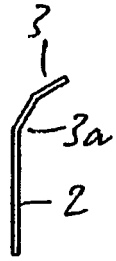
FIG. 8 is a sectional view of the same along the line A-A in FIG. 7.

In the design shown in FIGS. 5-8 of the drawings, the extinguisher comprises a slotted, resilient bushing 2, made of thin metal foil or sheeting, for example 0.2 mm resilient sheet steel. At one end, the bushing is slotted into a number of tongues 3. The tongues 3 are shaped like pointed teeth and have, by pre-bending or stamping of the material, been bent into an angle, as shown in FIG. 8. When the sheet is subsequently rolled or bent into the shape of a bushing (FIG. 5), the tongues 3 will together form a closed taper or cone 4.

Owing to the elasticity and resilience of the material the tongues 3 are able to deflect radially outward when the bushing 2 is placed on a candle 5. This allows the extinguisher to be placed in any desired position on the candle, meaning that optimum protection against ignition of surrounding material can be provided in all circumstances. When the candle has burnt down to the level of the tongues 3, the own spring action of the tongues 3 will cause them to move back toward their initial shape, i.e., closed, to form the above-mentioned closed conical shape (see FIGS. 5 and 9). In that way, the flame will be smothered and the candle will be extinguished effectively.

The tongues 3 are suitably provided with stamped bending zones 3*a*, where the elastic deflection chiefly takes place. The bending zones 3*a* are line-shaped sections of material where the material thickness has been suitably reduced by stamping. The reduced material thickness will increase the elastic flexibility of the material along these lines, so that the deflection of the tongues chiefly will take place along the bending zones (see FIG. 8). The bending zones thus ensure precise and well-defined re-bending of the tongues when they close.

Figure 9:
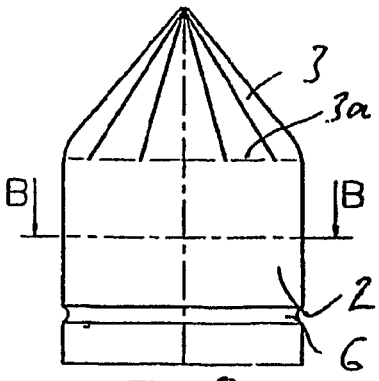
FIG. 9 shows a side view of a different design of the extinguisher.
Figure 11:
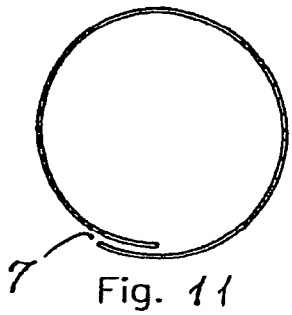
FIG. 11 is a sectional view along the line B-B in FIG. 9.

FIGS. 9-11 show an extinguisher design where the bushing is provided with an internal bulge 6. The bulge 6 contributes to holding the extinguisher in place on the candle when the candle is tapered. FIG. 11 shows how the bushing 2 has been rolled into a specific initial diameter where the ends 7 of the metal strip overlap. In that way the bushing obtains the above-mentioned self-retaining property through spring action when the extinguisher has been positioned on the candle.

The invention is not limited to the design shown in the drawings and described above. Other combinations of materials, other design details, and other constructive solutions regarding the individual components of the extinguisher are conceivable within the framework of this invention, and the use of the extinguisher may be extended to areas other than those described above.

Although the present invention has been described above with reference to specific and presently preferred embodiments of the candle extinguisher according to the present invention and according to a method also constituting part of the present invention, the candle extinguisher and the method of producing a candle extinguisher may be modified in numerous ways, as will be evident to a person having ordinary skill in the art, without deviating from the scope and intention of the invention, as defined in the appending claims.

The invention claimed is:

1. An extinguisher for use on a candle, where the candle is placed in a candlestick or similar holder and where the purpose of the extinguisher is to extinguish the candle once it has burnt down to a specific height, the extinguisher comprising:

a resilient, slotted metal bushing, which at one end is provided with a plurality of radially inward-facing resilient tongues that, by their spring action, in the initial shape of the bushing, close to a closed position at the end of the bushing;

wherein the bushing is configured and dimensioned for placement on the outside of a candle at a selected height on the candle at which the candle should be extinguished;

the tongues bend radially outward by elastic deflection;

the bushing is made of a bimetal that changes shape when heated; and the bimetal is positioned in such a way in the bushing that the tongues will increase their inward curve toward the center of the bushing when the material is heated by the flame.

2. The extinguisher according to claim 1, wherein the bushing, in its initial shape, has a diameter less than the diameter of the smallest candle on which the extinguisher is to be placed, making the extinguisher self-retaining on the candle over a relatively large range of candle diameters as a result of a resilient clamping action radially around the candle.

3. The extinguisher according to claim 1, wherein the bushing is made of thin sheet steel of a thickness ranging from about 0.1-0.3 mm.

4. The extinguisher according to claim 1, wherein the radially inward-facing resilient tongues, at their free ends, are pointed so that the tongues in their closed position together form a cone-like shape that is closed at the top.

5. The extinguisher according to claim 1, wherein each of the tongues has been pre-bent or stamped in one or more line-shaped bending zones that partly provide the tongues with the said closed position in neutral initial position, and partly provide the tongues with a suitable spring effect allowing the tongues to deflect outward when the extinguisher is placed on the candle.

6. The extinguisher according to claim 1, wherein the bushing is provided with a radially inward-facing ring-shaped bulge placed in an area between a downward-facing edge of the bushing and an upward-facing edge that is formed into the tongues.

7. The extinguisher according to claim 1 wherein he bushing is made by rolling a strip of metal foil into a diameter less than the smallest candle diameter on which the extinguisher is to be used, so that the elastic properties of the material are used to obtain resilient adjustment to various candle diameters within a relatively wide candle diameter range, and so that the resilience makes the extinguisher self-retaining in the selected position on the candle.

8. The extinguisher according to claim 1, wherein ends of the bushing overlap one another, but are not secured to one another, such that the ends are freely movable with respect to one another to enable a diameter of the bushing to be varied.

* * * * *